United States Patent [19]

von Hagen et al.

[11] Patent Number: 5,019,180

[45] Date of Patent: May 28, 1991

[54] METHOD OF MANUFACTURING OF HIGH-STRENGTH SEAMLESS STEEL TUBES

[75] Inventors: Ingo von Hagen, Krefeld; Christoph Prasser, Essen; Gerd Homberg, Mettmann, all of Fed. Rep. of Germany

[73] Assignee: Mannesmann Aktiengesellschaft, Düsseldorf, Fed. Rep. of Germany

[21] Appl. No.: 477,047

[22] Filed: Feb. 7, 1990

[51] Int. Cl.[5] ..... C21D 8/10

[52] U.S. Cl. ..... 148/12 B; 148/12.4; 148/12 F

[58] Field of Search ..... 148/12 F, 12 B, 12.4

[56] References Cited

FOREIGN PATENT DOCUMENTS 53-97922 8/1978 Japan ..... 148/12 F

*Primary Examiner*—Deborah Yee

*Attorney, Agent, or Firm*—Cohen, Pontani & Lieberman

[57] ABSTRACT

A method of manufacturing high-strength seamless steel tubes by hot-rolling followed by accelerated cooling in which feed ingots of a steel annealed with aluminum and/or silicon of the following composition in weight per cent:

| | |
|---|---|
| 0.08–0.13% | C |
| 1.40–1.90% | Mn |
| 0.20–0.50% | Cr |
| 0–0.50% | Mo |
| 0–0.70% | Ni |
| 0–0.40% | Cu |
| 0.04–0.13% | V |
| max. 0.020% | P |
| max. 0.010% | S |

and wherein the balance comprises iron and ordinary impurities, the sum of the contents of Cr and Mo is within the range of about 0.20 to about 0.70% and the Cu/Ni quantity ratio in case of the presence of both elements is limited to at most 1, are heated to a temperature of about 1150° to about 1280° C. and hot-rolled into tubes in multiple stages and, after leaving the last hot-rolling stage, the tubes which have a temperature above $A_{r3}$ are quenched directly from the rolling heating in about 5 to about 50 seconds, substantially avoiding formation of ferrite, down to a temperature range of about 340°–560° C. and thereafter the tubes are further cooled in air.

5 Claims, 1 Drawing Sheet

METHOD OF MANUFACTURING OF HIGH-STRENGTH SEAMLESS STEEL TUBES

FIELD OF THE INVENTION

The present invention relates to a method of manufacturing high-strength seamless steel tubes by hot rolling followed by accelerated cooling from the rolling heat. The tubes are suitable for use as oil-field and conduit pipes and comply at least to API-grade X70.

BACKGROUND OF THE INVENTION

Seamless tubes are customarily manufactured by the hot rolling of steel ingots which have been heated to about 1200°–1250 C. The main shaping of the rolling process takes place just below the ingot drawing temperature and therefore at very high temperatures. The recrystallization of the structure caused by the shaping leads, because of these high temperatures, to strong grain growth and, accordingly, to a corresponding impairment of the toughness of the material. Therefore, up to now it has always been considered necessary to follow the rolling process by a separate heat treatment in the form of a normalization or age-hardening process thereby obtaining a finer structure and improving the toughness properties by re-granulation.

Such a heat treatment requires a considerable expenditure of time and money so that it appeared desirable to avoid this additional treatment. In principle, it is possible by a targeted cooling, after the hot rolling, to produce a bainitic structure in the tube and, therefore, to substantially avoid both ferrite formation and martensite formation. A bainitic structure, in addition to providing high strength values, exhibits good toughness properties. This method has, however, scarcely been possible up to now on a large industrial scale since the control of the temperature during the accelerated cooling step could not be effected in such a manner as to assure the reaching of the bainite region.

This is due to the fact that the individual steel tubes invariably have temperatures which not only differ from each other at the end of the last rolling step but also show considerable differences in temperature over the length of the tube and even over the circumference of the tube. These differences in temperature amount typically to up to about 100° C. and can be measured at the end of the accelerated cooling step in approximately unchanged amount. Therefore, in actual practice, a fixed cooling temperature cannot be achieved.

This, however, means that, due to the cooling, a bainite region is obtained in the desired manner only in individual zones of the tube, while in the other zones ferrite is produced (by excessively slow or insufficiently deep cooling) or else martensite (due to excessively deep cooling). As a whole, such tubes have toughness and strength properties which differ greatly from each other locally and they are thus not suitable for the intended use.

From Federal Republic of Germany 33 11 629 C2 a method is known, however, which permits the manufacture of high-strength seamless oil-field tubes of good toughness properties from a steel having the following composition:

| | |
|---|---|
| 0.02–0.12% | C |
| 1.30–2.20% | Mn |
| max. 0.30% | Mo |

-continued

| | |
|---|---|
| max. 0.50% | Ni |
| 0.01–0.04% | Ti |
| 0.02–0.06% | Nb |
| 0.003–0.008% | N |
| 0.03–0.05% | Al |
| 0.001–0.003% | B |
| 0.001–0.010% | S |

the balance being iron and ordinary impurities.

In order to obtain a finely granular structure, the prior art method provides for a controlled final rolling at low temperatures (700°–850° C.), whereby a completely uniform starting temperature is assured by a previously effected equalizing annealing over the length of the tube after it has been prerolled in the hot.

After the final rolling, the tube is cooled with water and/or air to room temperature and finally also tempered in order to improve the strength properties. The intermediate or subsequent heat treatment means an additional expense with respect to technical plant and energy consumption.

SUMMARY OF THE INVENTION

An object of the invention is, therefore, to provide a method of manufacturing seamless steel tubes having high yield point and high tensile strengths with, at the same time, good toughness properties ($A_{v+20°\ C.} > 60J$) (API-grade X70 or higher) without having to subject the tubes to an additional heat treatment after rolling. According to this method, temperature differences in the rolled tubes directly before the cooling of the tube of between about 100–150 K are permissible without jeopardizing the desired properties. The tubes can also be produced at low price and therefore do not require large quantities of expensive alloy elements.

This object is achieved by a method of manufacturing high strength seamless steel tubes by hot rolling followed by accelerated cooling, which comprises (a) providing feed ingots of a steel annealed with aluminum and/or silicon having the following composition in weight per cent:

| | |
|---|---|
| 0.08–0.13% | C |
| 1.40–1.90% | Mn |
| 0.20–0.50% | Cr |
| 0–0.50% | Mo |
| 0–0.70% | Ni |
| 0–0.40% | Cu |
| 0.04–0.13% | V |
| max. 0.020% | P |
| max. 0.010% | S |

the balance being iron and ordinary impurities, the sum of the contents of Cr and Mo lying within the range of about 0.20 to about 0.70% and the Cu/Ni quantity ratio in case of the presence of both elements being limited to at most 1; (b) heating said feed ingots to a temperature of about 1150 to about 1280° C. and hot-rolling said ingots into tubes in multiple stages; and (c) after leaving the last hot-rolling stage, quenching said tubes having a temperature above $A_{r3}$ directly from the rolling heat in about 5 to about 50 seconds preferably substantially avoiding formation of ferrite down to a temperature range of about 340°–560° C. and thereafter further cooling said tubes in air. By "substantially" avoiding formation of ferrite is meant that the formation of ferrite does not exceed about 10%. The steel composition of the present invention does not contain more than about 0.04% by weight of Nb and Ti.

DETAILED DESCRIPTION OF THE PRESENTLY PREFERRED EMBODIMENT

The solution in accordance with the inventions consists essentially of a distinct selection of a steel material with narrow limits for the individual alloy elements and pre-determined dimensioning rules for the content of individual elements with respect to each other, as well as of a controlled quenching treatment which is specifically adapted to this material. It has, accordingly, been possible to find a steel which cannot only be produced at low cost since it does not require large amounts of expensive alloy elements, but which also surprisingly assures the formation of bainite over a wide temperature range (for instance, 150 K) of the cooling (catch temperature). The production of ferrite can easily be limited to noncritical values of less than about 10% per weight of the structure. It has been found that the ratio of the elements copper and nickel to each other as well as the sum of the contents (weight per cent) of Cr and Mo are of extreme importance for the cooling behavior with reference to the obtaining of uniform strength and toughness values. This is also true of the narrowly limited content of carbon. Unless otherwise indicated all parts and percentages are by weight. When the predetermined composition is maintained, a steel is obtained which exhibits practically equally good values with respect to the final temperature of the quenching treatment within a broad temperature range. In this connection it is immaterial under what conditions the feed ingots are present (for example, cast ingots, round continuous castings, rounded square continuous castings, rolledround steel).

Figure 2:
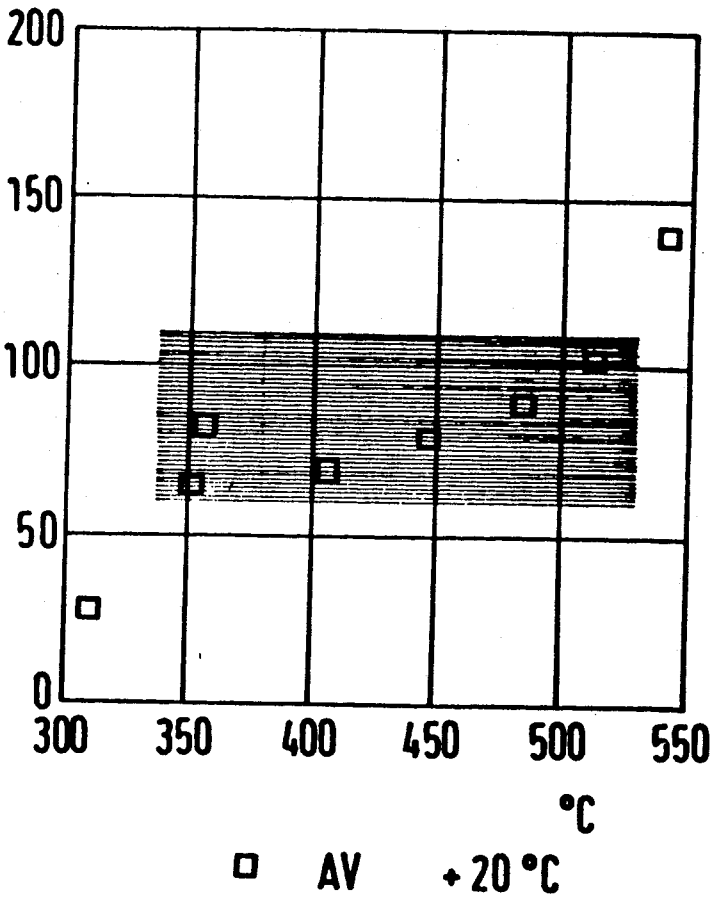
FIG. 2 is a graph illustrating further beneficial properties achieved with the method of the present invention, the abscissa indicating notched bar impact work at 20° C. in $J(A_{v+20° C.})$ and the ordinate indicating the catch temperature in ° C.
Figure 1:
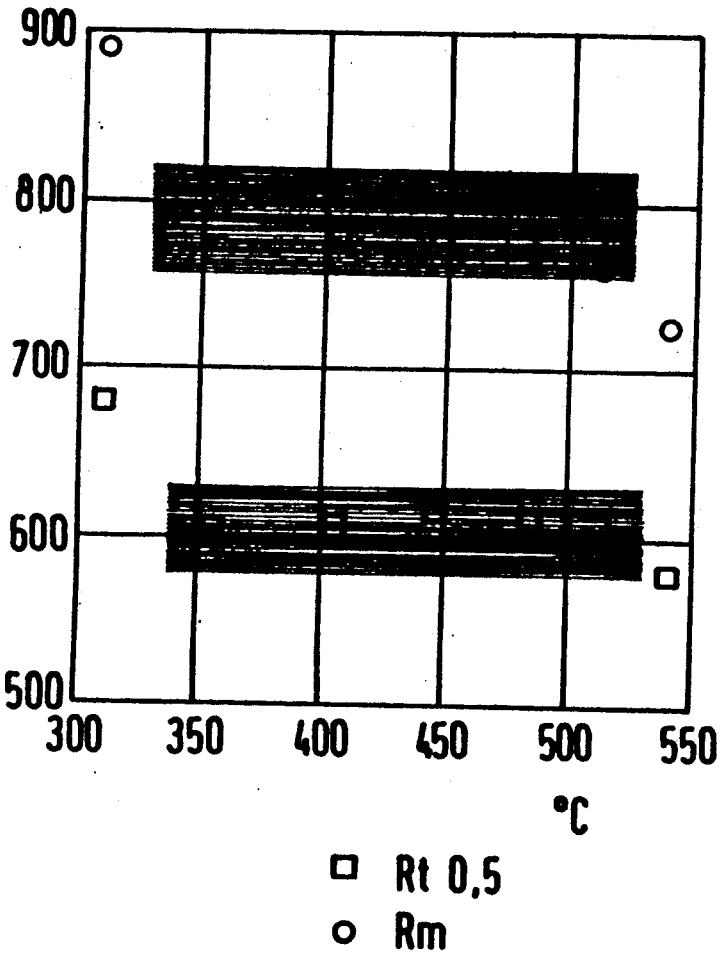
FIG. 1 is a graph illustrating the beneficial properties achieved with the method of the present invention, the abscissa indicating strength values in $N/mm^2$ and the ordinate indicating tensile strength ($R_m$) and yield point $R_{f0.5}$.

The effectiveness of the method of the present invention is further demonstrated by the values of the tensile strength $R_m$ and the yield point $R_{f0.5}$ or notched bar impact work $A_{v+20° C.}$ as a function of the catch temperature of the accelerated cooling shown, for example, in FIGS. 1 and 2. The values found refer to a steel having the following composition:

| | |
|---|---|
| 0.09% | C |
| 1.5% | Mn |
| 0.25% | Cr |
| 0.06% | V |
| 0.04% | Nb |
| 0.016% | P |
| 0.003% | S |

the balance being iron and ordinary impurities.

As can be noted from FIG. 1, the measured values of the yield point and of the tensile strength are approximately at a constant level with a catch temperature range of 350°-520°. The yield point ratios $R_{f0.5}/R_m$ are, in all cases, less than 80%. Despite the coarse initial structure, the steel which has been subjected to the cooling treatment of the present invention has good notched bar impact work values (FIG. 2). In the range of the catch temperature from 350°-520° C., it is in all cases clearly more than 50 J at a test temperature of +20° C.

The method of the present invention renders possible, with the use of a low-cost alloy and despite the dispensing with a costly and separate heat treatment, to manufacture high-strength steel tubes such as oil-field and conduit pipes. By the accelerated cooling from the rolling heat, a bainite structure having good toughness properties over the entire length of the tube is definitely produced, even on tubes which exhibit a non-uniform temperature distribution. Differences in the catch temperature of up to about 150 K and, depending on the composition of the alloy, above this temperature, do not have a critical effect on the strength or toughness properties of the tubes so produced.

While there has been described and illustrated a preferred embodiment of the present invention, it is apparent that numerous alterations, omissions and additions may be made without departing from the spirit and scope of the invention thereof.

It should also be understood that the preferred embodiment and example described above are for illustrative purposes only and are not to be construed as limiting the scope of the invention which is properly delineated only in the appended claims.

What is claimed is:

1. A method of manufacturing high-strength seamless steel tubes by hot rolling followed by accelerated cooling, comprising the following steps:

a) providing feed ingots of a steel annealed with aluminum and/or silicon, having the following composition in weight per cent:

| | |
|---|---|
| 0.08–0.13% | C |
| 1.40–1.90% | Mn |
| 0.20–0.50% | Cr |
| 0–0.50% | Mo |
| 0–0.70% | Ni |
| 0–0.40% | Cu |
| 0.04–0.13% | V |
| max. 0.020% | P |
| max. 0.010% | S |

the balance being iron and impurities, the sum of the contents of Cr and Mo lying within the range of about 0.20 to about 0.70% and the Cu/Ni quantity ratio in case of the presence of both elements being limited at most 1;

b) heating said feed ingots to a temperature of about 1150 to about 1280° C. and hot-rolling said ingots into tube in multiple stages; and c) after leaving the last hot-rolling stage, quenching said tubes having a temperature above $A_{r3}$ directly from the rolling heat in about 5 to about 50 seconds substantially avoiding formation of ferrite down to a temperature range of about 340°-560° C. and thereafter further cooling said tubes in air.

2. The method according to claim 1, wherein at most about 0.04% by weight of Nb is added to said steel.

3. The method according to claim 1, wherein at most about 0.04% by weight of Ti is added to said steel.

4. The method according to claim 2, wherein at most 0.04% by weight of Ti is added to said steel.

5. The method according to claim 1, wherein the ferrite formation does not exceed 10% vol.

* * * * *